United States Patent [19]

Farley

[11] Patent Number: 4,497,349

[45] Date of Patent: Feb. 5, 1985

[54] SOLUTION DISPENSER

[75] Inventor: Donald V. Farley, Crestline, Calif.

[73] Assignee: Loma Linda University Medical Center, Loma Linda, Calif.

[21] Appl. No.: 346,629

[22] Filed: Feb. 8, 1982

[51] Int. Cl.[3] ..... G21F 5/00

[52] U.S. Cl. ..... 141/19; 128/1.1; 222/5; 250/506.1

[58] Field of Search ..... 128/1.1; 141/2, 4, 5, 141/9, 18, 19, 25, 27, 37, 39, 51, 63, 100, 105, 107, 329, 330; 220/426; 222/5; 250/506.1; 261/121; 285/140, 141

[56] References Cited

U.S. PATENT DOCUMENTS

| | | | |
|---|---|---|---|
| 2,064,815 | 12/1936 | Armstrong | 141/329 X |
| 2,514,909 | 7/1950 | Strickland | 250/506.1 X |
| 3,256,000 | 6/1966 | Howlett, Jr. | 220/426 X |
| 3,481,323 | 12/1969 | Cook et al. | 222/5 X |
| 3,848,773 | 11/1974 | Adler et al. | 222/5 X |
| 4,083,187 | 4/1978 | Nagashima | 222/5 X |

OTHER PUBLICATIONS

Prior Art Solution Dispenser: Sketch, Photograph, & Description; dated 1-13-82: Copy in File.

*Primary Examiner*—Stephen Marcus
*Assistant Examiner*—Mark Thronson
*Attorney, Agent, or Firm*—Harris, Kern, Wallen & Tinsley

[57] ABSTRACT

An apparatus for dispensing a gas contained in a sealed ampule, typically a radioactive gas dissolved in a saline solution. A housing with a cavity for receiving the ampule, the housing having a lead shield surrounded by a steel sleeve, and a cap for closing the cavity in the shield. First and second flow paths are provided in the housing from the exterior of the housing to a seat which engages the ampule output line. A syringe is attached on the outside of the housing and connects with the first flow path. A hollow needle is positioned in the second flow path with one end entering the ampule outlet line for breaking the ampule seal. A valve on the outer end of the needle is normally closed so that when the needle breaks the seal, liquid from the syringe is drawn into the ampule with the gas dissolving in the liquid. Then the gas-liquid solution is withdrawn through the needle and valve.

4 Claims, 3 Drawing Figures

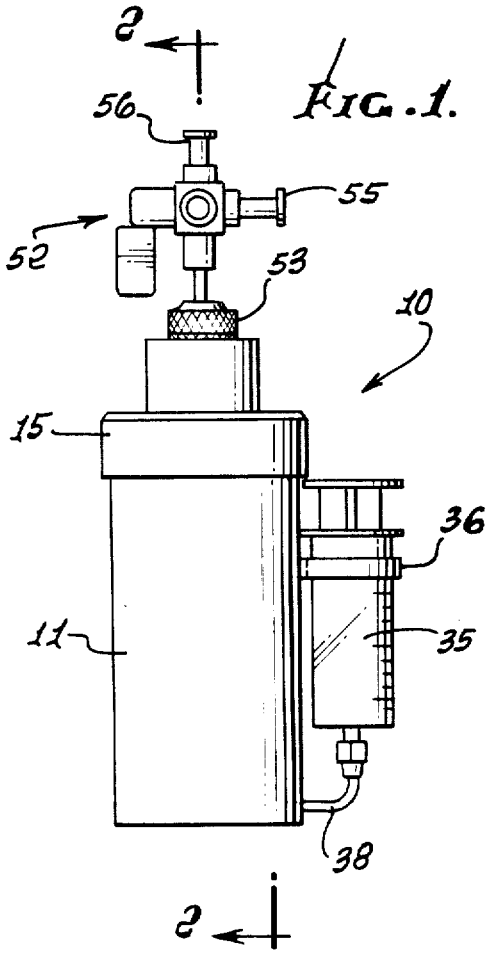
FIG. 1.
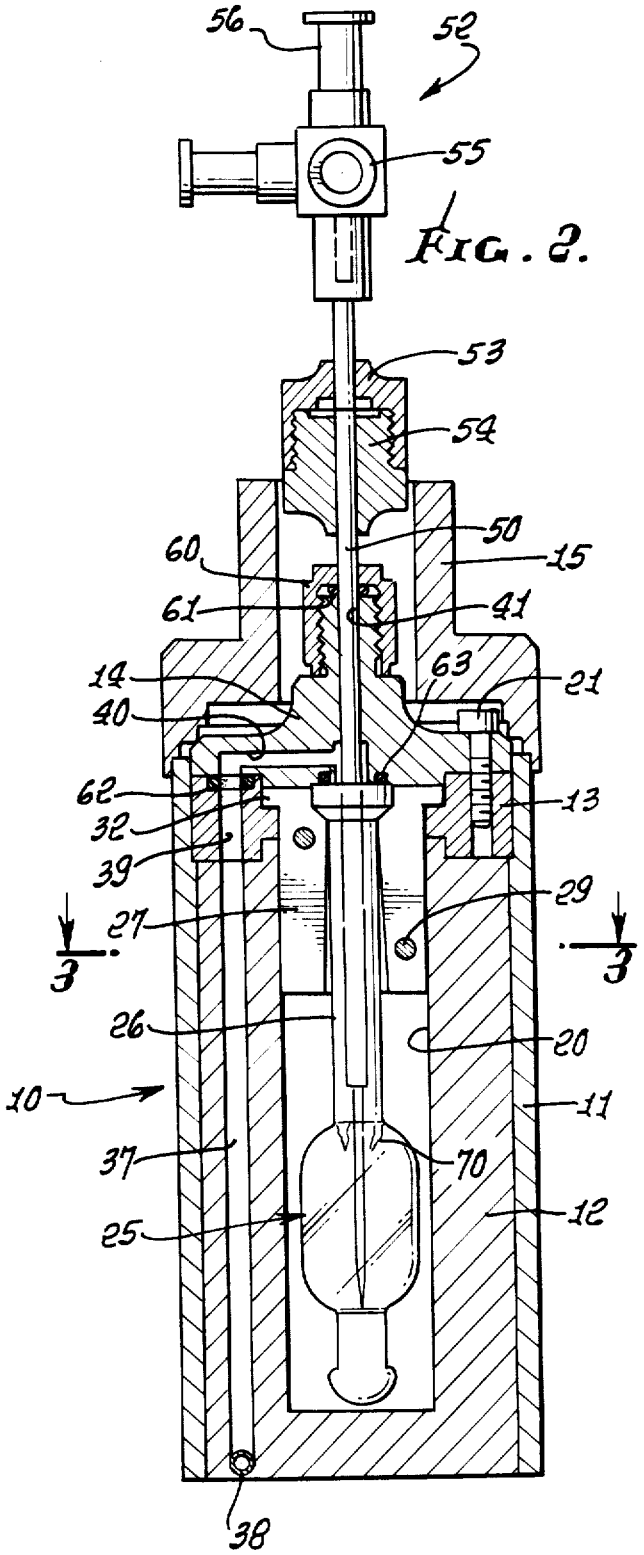
FIG. 2.
FIG. 3.
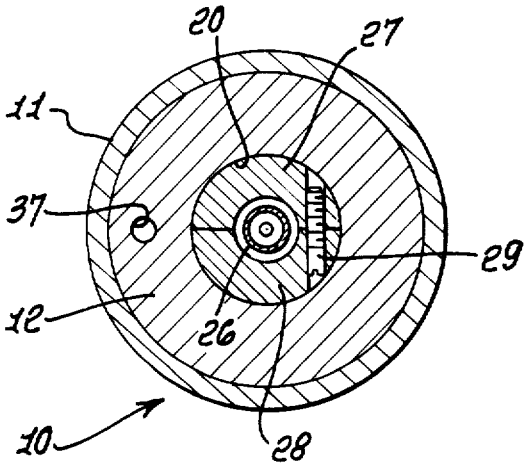

SOLUTION DISPENSER

BACKGROUND OF THE INVENTION

This invention relates to apparatus for mixing a gas and a liquid, and for dispensing the resultant solution. In some fields, especially the medical field, it is desirable to dissolve a gas in a liquid without loss of the gas and without contamination of the solution. One specific use for the apparatus is the dissolving of a radioactive gas such as xenon-133 in a liquid such as saline to provide a radioactive solution and provide for extraction of a portion of the solution for subsequent use such as tracering in medical analysis. For such applications, the dispenser should also provide radioactive shielding for protection of personnel handling the equipment.

One such apparatus is shown in U.S. Pat. No. 3,742,988. In this apparatus, a crushable ampule is positioned in a closed container which is charged with the saline. The ampule is crushed or broken by a lead screw positioned in a cap for the container to permit mixture of the gas and liquid. An inlet line provides for introducing the saline into the container, and an outlet line provides for withdrawing the solution.

This prior art device has a number of disadvantages. It is not well suited for use with small volumes, in the order of 5 to 6 cubic centimeters as compared to 30 cubic centimeters. The device requires crushing of the ampule within the container. Also, the gas is mixed with the liquid in the container rather than in the ampule, thereby lowering the concentration of the radioactive gas in the liquid and increasing the possibility of contamination.

In another prior art apparatus which has been in use for several years, the larger portion of an ampule is enclosed in plaster, a syringe cap is attached to the ampule neck by a rubber tube, a syringe is coupled to the interior of the rubber tube by a plastic line and a small needle through the syringe cap, and a larger needle with a valve at the outer end is inserted through the syringe cap into the ampule neck to break the ampule seal.

This prior art device also has disadvantages. The ampule neck often broke at the time the seal was broken or during subsequent use and there was considerable gas leakage. The unit was akward to assemble and handle, and time was required to initially seal the ampule in plaster.

Accordingly, it is an object of the present invention to provide a new and improved apparatus for mixing a gas and a liquid and for dispensing the resultant solution. A particular object is to provide such an apparatus which is especially well suited for handling small volumes, typically 5 to 6 cubic centimeters and less. Another object is to provide such an apparatus wherein the ampule is fully enclosed and protected in a housing and maintained intact, with the liquid being introduced into the ampule for mixing with the gas. An additional object is to provide such an apparatus incorporating a collar for clamping the ampule in place and a cap for sealing engagement with the ampule, with flow paths for gas and liquid within the housing and cap. Other objects, advantages, features and results will more fully appear in the course of the following description.

SUMMARY OF THE INVENTION

An apparatus for dispensing a gas contained in a sealed ampule by dissolving the gas in a liquid and withdrawing the resultant solution in quantities as desired. The apparatus includes a housing with a cavity for receiving the ampule with the housing having a cap or the like for retaining the ampule, a seat for engagement with the ampule output line, and flow paths from the exterior of the housing to the seat. The apparatus also includes means for connecting a syringe to one of the flow paths. A hollow needle is positioned in the other flow path with an end entering the ampule output line for breaking the seal within the ampule with the resultant inflow of liquid from the syringe into the ampule and dissolving of the gas into the liquid. The gas-liquid solution may then be withdrawn through the needle, with needle flow controlled by a valve carried on the needle. A split collar is positioned about the ampule outlet line for inserting and removing the ampule, and for fixing the ampule in the housing, with the main body of the ampule spaced from the housing and with the mouth of the ampule outlet line engaging the cap in sealing relation.

BRIEF DESCRIPTION OF THE DRAWING

FIG. 1 is a side view of a dispenser incorporating the presently preferred embodiment of the invention;

FIG. 2 is an enlarged sectional view taken along the line of 2—2 of FIG. 1; and FIG. 3 is a sectional view taken along the line 3—3 of FIG. 2.

DESCRIPTION OF THE PREFERRED EMBODIMENT

The dispenser as shown in the drawing includes a housing 10 with a steel sleeve 11 positioned about a lead shield 12, a ring 13, a cap 14, and a cover 15. The lead shield 12 has a cavity 20 which is closed at the bottom and open at the top. The ring 13 typically is of steel and preferably is a press fit into the upper end of the sleeve 11, with the cap 14 being removably attached to the ring 13 by a plurality of screws 21. The cap 14 typically also is made of steel, with the cover 15 preferably formed of lead with a steel outer covering for mechanical protection. The cover 15 is a push fit on the sleeve 11.

A glass ampule 25 is positioned within the cavity 20, with an outlet line or neck 26 of the ampule clamped between the two halves 27, 28 of a split collar by guide pins 29. The split collar 27, 28 slides in the cavity 20, with an upper rim 32 of the collar fitting in a mating recess in the ring 13. The collar provides for ease of insertion and removal of the ampule, and also serves to position the main body of the ampule within the cavity 20 and spaced from the inner walls of the shield 12, thereby reducing the likelihood of breakage of the ampule. Also the collar serves to hold the mouth at the end of the neck 26 against the cap 14.

A syringe 35 is attached to the housing, as by a band 36, with the syringe outlet connected to a passage 37 in the shield 12 by a line 38. The passage 37 communicates with the mouth of the outlet line 26 of the ampule through passages 39 in the ring 13 and 40 in the cap 14. Another passage 41 in the cap 14 also communicates with the mouth of the ampule outlet line.

A hollow needle 50 may be positioned in the passage 41 and in the outlet line 26. A three-way valve 52 is positioned in a cap 53 which is threaded onto a hub 54 carried at the upper end of the needle 50. A filter may be positioned between the cap 53 and hub 54 if desired.

The valve 52 provides for directing flow between the needle 50 and outlet 55, or between the needle 50 and outlet 56, or for blocking flow from the needle. A small cap 60 is threaded onto the upper end of the cap 14 for holding an O-ring seal 61 which engages the needle 50 in sealing relation. Another O-ring seal 62 may be positioned in a recess in the ring 13 for sealing engagement about the flow path between the ring 13 and cap 14. Another O-ring 63 may be positioned in a groove at the seat of the cap 14 for sealing engagement with the mouth of the ampule.

In operation, the ampule is clamped between the halves 27, 28 of the split collar. The ampule is then inserted into the cavity 20 as shown in FIG. 2. The cap 14 is placed over the ampule and fastened in place by the screws 21, and the cover 15 is placed in position as shown in FIG. 2. The syringe 35 is charged with the desired liquid. The needle with the valve in the closed position is inserted through the cap 14 into the outlet line 26 of the ampule, and is pushed downward to break the internal seal 70 of the ampule. The gas in the ampule is at a pressure below ambient, that is, there is a vacuum in the ampule. Hence when the seal 70 is broken, the liquid in the syringe flows through line 38 and passages 37, 39 and 40 into the interior of the ampule, and the gas originally in the ampule dissolves into the liquid, forming the desired solution.

The solution is now ready for dispensing and may be withdrawn by connecting a syringe or line or otherwise as desired to one of the outlets 55, 56 and appropriately actuating the valve. With this arrangement, mixing of the gas and liquid is accomplished within the ampule. Also, small quantities of solution can be prepared, and portions of the solution can be withdrawn for use as desired. As solution is withdrawn, saline in the ampule may be replenished from the syringe 35.

I claim:

1. In an apparatus for dispensing a gas contained in a sealed ampule having an outlet line, the combination of:

a housing having a cavity for receiving said ampule, said housing including means for retaining said ampule therein, seat means for engagement with said ampule outlet line, and means defining first and second fluid flow paths from the exterior of said housing to said seat means;

means for connecting a syringe to said first flow path;

a hollow needle for positioning in said second flow path and having a first end for entering said ampule outlet line and a second end projecting from said housing; and a valve for closing said second end of said needle;

whereby a liquid in said syringe is drawn into said ampule when the ampule seal is broken by insertion of said needle with said valve closed so that said gas is dissolved in said liquid, permitting withdrawal of gas-liquid solution through said needle and valve when said valve is open;

said housing including a lead shield with said cavity therein, a steel sleeve about said shield, a cap for closing said cavity, and a cover over said cap and engaging said sleeve, with said first flow path in said shield and cap and said second flow path in said cap, and said means for retaining including a split collar attached about said outlet line and fitting in a ring positioned between said shield and cap.

2. In an apparatus for dispensing a gas contained in a sealed ampule having an outlet line, the combination of:

a housing having a cavity for receiving said ampule, said housing including means for retaining said ampule therein, seat means for engagement with said ampule outlet line, means defining first and second fluid flow paths from the exterior of said housing to said seat means, and a cap closing said cavity;

means for connecting a syringe to said first flow path;

a hollow needle for positioning in said second flow path and having a first end for entering said ampule outlet line and a second end projecting from said housing; and a valve for closing said second end of said needle;

whereby a liquid in said syringe is drawn into said ampule when the ampule seal is broken by insertion of said needle with said valve closed so that said gas is dissolved in said liquid, permitting withdrawal of gas-liquid solution through said needle and valve when said valve is open;

said means for retaining including a split collar about said outlet line, with said collar sliding within said cavity to support said ampule in said cavity, and means for clamping of said collar to said housing by said cap with the outer end of said outlet line engaging said cap.

3. In an apparatus for dispensing a gas contained in a sealed ampule having an outlet line, the combination of:

a housing having a cavity for receiving said ampule, said housing including means for retaining said ampule therein, seat means for engagement with said ampule outlet line, and means defining first and second fluid flow paths from the exterior of said housing to said seat means;

a syringe mounted on said housing and connected to said first flow path;

a hollow needle for positioning in said second flow path and having a first end for entering said ampule outlet line and a second end projecting from said housing; and a valve for closing said second end of said needle;

whereby a liquid in said syringe is drawn into said ampule when the ampule seal is broken by insertion of said needle with said valve closed so that said gas is dissolved in said liquid, permitting withdrawal of gas-liquid solution through said needle and valve when said valve is open;

said housing including a lead shield with said cavity therein, and a cap for closing said cavity, with said first flow path in said shield and cap and said second flow path in said cap, and said means for retaining including a split collar attached about said outlet line and fitting in a ring positioned between said shield and cap.

4. In an apparatus for dispensing a gas contained in a sealed ampule having an outlet line, the combination of:

a housing having a cavity for receiving said ampule, said housing including means for retaining said ampule therein, seat means for engagement with said ampule outlet line, means defining first and second fluid flow paths from the exterior of said housing to said seat means, and a cap closing said cavity;

a syringe mounted on said housing and connected to said first flow path;

a hollow needle for positioning in said second flow path and having a first end for entering said ampule outlet line and a second end projecting from said housing; and a valve for closing said second end of said needle;

whereby a liquid in said syringe is drawn into said ampule when the ampule seal is broken by insertion of said needle with said valve closed so that said gas is dissolved in said liquid, permitting withdrawal of gas-liquid solution through said needle and valve when said valve is open;

said means for retaining including a split collar about said outlet line, with said collar sliding within said cavity to support said ampule in said cavity, and housing means for clamping of said collar to said housing by said cap with the outer end of said outlet line engaging said cap.

* * * * *